US006370714B1

(12) United States Patent
Elzenbeck

(10) Patent No.: US 6,370,714 B1
(45) Date of Patent: Apr. 16, 2002

(54) LOUNGE CHAIR

(75) Inventor: Manfred Elzenbeck, Steinheim (DE)

(73) Assignee: Rössle & Wanner GmbH, Mössingen (DE)

( * ) Notice: Subject to any disclaimer, the term of this patent is extended or adjusted under 35 U.S.C. 154(b) by 0 days.

(21) Appl. No.: 09/530,269

(22) PCT Filed: Aug. 3, 1999

(86) PCT No.: PCT/EP99/05569

§ 371 Date: Apr. 28, 2000

§ 102(e) Date: Apr. 28, 2000

(87) PCT Pub. No.: WO00/11987

PCT Pub. Date: Mar. 9, 2000

(30) Foreign Application Priority Data

Aug. 28, 1998 (DE) ..... 198 39 166

(51) Int. Cl.[7] ..... A47C 13/00

(52) U.S. Cl. ..... 5/110; 5/114; 5/112; 5/111

(58) Field of Search ..... 5/110, 114, 198, 5/111, 112, 116, 117; 297/118, 16.1, 452.13, 440.11, 218.1, 219.1

(56) References Cited

U.S. PATENT DOCUMENTS

| | | | | | |
|---|---|---|---|---|---|
| 909,620 | A | * | 1/1909 | Lamb | 5/110 |
| 3,716,271 | A | * | 2/1973 | Kurz | 5/110 |
| 4,848,843 | A | | 7/1989 | Gibbs | 297/440 |
| 5,507,563 | A | | 4/1996 | Arthur, Jr. | 297/440.23 |
| 5,762,403 | A | | 6/1998 | Robinson | 297/440.11 |
| 5,992,348 | A | * | 11/1999 | Harding | 5/110 |

FOREIGN PATENT DOCUMENTS

| | | |
|---|---|---|
| DE | 44 26 316 | 12/1995 |
| DE | 198 07 741 | 10/1999 |

* cited by examiner

*Primary Examiner*—Lynne H. Browne
*Assistant Examiner*—Fredrick Conley
(74) *Attorney, Agent, or Firm*—Crowell & Moring LLP

(57) ABSTRACT

Lounger beds have a lying surface made of a textile structure clamped into a frame to permit a division of the lying surface into areas with different tension. A textile structure with elastic threads is fastened to longitudinal spars of the frame. The top side, of the longitudinal space has a curved construction form supporting surfaces for the textile structure only in an exterior area. The longitudinal spars have receiving grooves only on the exterior side for the edge of the textile structure to be clamped in.

32 Claims, 4 Drawing Sheets

LOUNGE CHAIR

This application claims the priority of German Patent Document 198 39 166.8 filed Aug. 28, 1998, and PCT/EP999/05569 filed Aug. 3, 1999, the disclosure of which is expressly incorporated by reference herein.

BACKGROUND AND SUMMARY OF THE INVENTION

The invention relates to a lounger bed with an adjustable lying surface which consists of a frame with transverse spars and buckling longitudinal spars and of a textile structure, particularly consisting of elastic threads, which is clamped in at least at the longitudinal spars.

Chairs or lounge chairs are known (German Patent Document DE 44 26 316 C1), in the case of which the sitting or the backrest surface is formed of a textile cover which is, in each case, shaped at its edges to form a loop and is pushed by means of these loops onto rod-type spanners which, in turn, are screwed to longitudinal spars of the chair frame. This further development permits the removal of the cover from the frame, for example, for the purpose of cleaning.

Loungers are also known in the case of which the cover is placed by means of loops at its edges directly around longitudinal spars of the frame. Such covers cannot easily be removed for the purpose of cleaning.

A lounger bed of the initially mentioned type was suggested by the applicant's Patent Application 198 07 741.6, in the case of which the textile structure to be used as the lying surface is equipped with elastic threads and, for replacing previously known bed frames, can be tensioned to different degrees in different sections between the transverse spars. The fastening of the covering fabric by means of loops on the longitudinal spars or the like cannot be used for such cases.

It is an object of the present invention to develop the covering frame for a lounger bed of the initially mentioned type such that a simple holding possibility is provided for the edges of the textile structure forming the lying surface and a possibility is provided to tension this textile structure to different degrees in different sections.

For achieving this object, it is provided in the case of a lounger bed of the initially mentioned type that the longitudinal spars and preferably also the transverse spars consist of profile strips with a curved top side, the textile structure reaching over this top side, in that the curving of the top side slopes down toward the interior of the frame and, only in the exterior area of the frame, supporting surfaces are formed for the textile structure whose edge is introduced into receiving grooves on the exterior side of the profile strips and is held there.

By means of this further development, it is, on the one hand, possible to form very stable longitudinal spars or transverse spars which are particularly necessary if the textile structure is provided with elastic threads and is clamped in between the parallel extending longitudinal spars and transverse spars while considerable restoring forces are exercised. However, the new further development also offers the advantage that, because of the supporting surfaces provided in the exterior area of the frame, the elastic supporting surface takes up almost the full frame surface, so that a very large laying surface is achieved. Because no frame is visible on the surface and the textile structure is pulled over the surface of the frame, the new further development also results in a very aesthetic appearance. Finally, the clamping-in operation can also be carried out in a simple manner, even if, in sections distributed along the length of the longitudinal spars, the textile structure is to be tensioned to different degrees.

As a further development of the invention, the receiving grooves are arranged at a distance, that is as small as possible, from the plane of the lying surface, and it is provided that the hinge axes for the buckling points of the longitudinal spars extend in a horizontal plane placed through the center of the receiving grooves. As the result of this further development, the buckling axes for the lying surface are situated very close to the plane of the laying surface itself, so that, without the arrangement of recesses on the textile structure in the hinge area, a continuous covering of the frame can be achieved, thus also in the area of the hinge points. During the buckling of the lying surface, which can be buckled up to 90° between the backrest part and the center part, because of the selected further development, no unattractive compressing of the textile structure will occur which, after an extended use, may damage this structure.

As a further development of the invention, the buckling points can be formed by hinge heads which each, in an alignment with the longitudinal spars, are held in the latter, are assigned to one another in pairs and, on their surface, are adapted to the profile contour of the longitudinal spars, for the backrest hinge situated between the center surface and the backrest surface, one recess respectively, which extends in a wedge-shaped manner to the swivelling axis and permits the swivelling movement, being arranged on the top side and, for a hinge situated between the foot part and the center part, in the buckled position, such a wedge-shaped gap is provided which is directed downward.

As a further development of the invention, it is now possible to construct the receiving groove as a slot, into which the edge of the textile structure is clamped. In this case, the slot can be formed of two adjoining parts which can be screwed to one another. However, it is significantly simpler for the receiving groove to be adapted to the cross-section of a rod, around which the textile structure is loosely wrapped and after the insertion is clamped in the receiving groove. This rod can in each case be divided into sections which each extend in the areas between the hinge heads.

As a further development of the invention, at least the longitudinal spars can consist of a hollow profile with a curved top side which, on the outside, merges into the receiving groove. This hollow profile may be made of a drawn metal or a plastic profile. However, it is also possible to produce the hollow profile from a correspondingly bent sheet metal strip, as the result of which, without any loss of stability, the weight of the new lounger bed and the manufacturing expenditures can be reduced.

In order to largely avoid problems when applying the textile structure to the frame as the cover, it can finally be provided that the textile structure is recessed at the corners of the supporting frame and is fastened only on the parts of the transverse spars and the longitudinal spars which extend perpendicularly to one another. This recessed edge area may, in a simple manner, be covered by a corner covering which is fastened to the longitudinal and transverse spars, so that an attractive appearance of the new lounger bed is achieved which is to be used instead of conventional bedsteads.

The invention will be illustrated in the drawing by means of embodiments and will be explained in the following.

BRIEF DESCRIPTION OF THE INVENTION

DETAILED DESCRIPTION OF THE DRAWINGS

Figure 1:
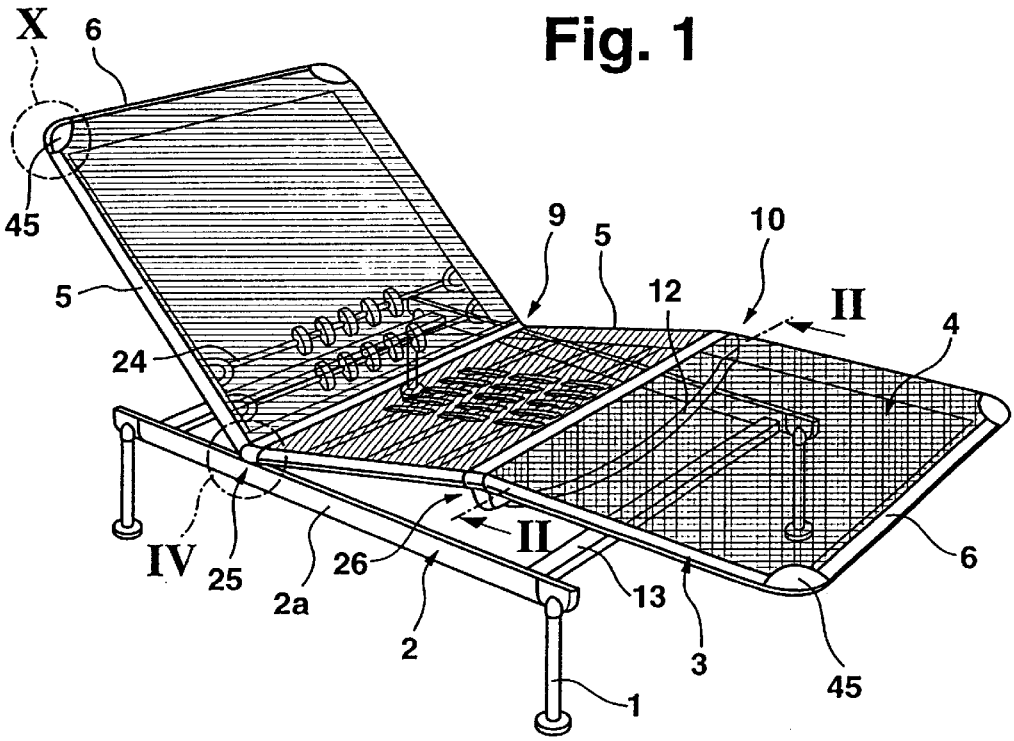
FIG. 1 is a perspective representation of a lounger bed according to the invention with differently aligned sections of the lying surface.

FIG. 1 illustrates a lounger bed which consists of a basic frame 2, which is provided with standing feet 1 and has longitudinal spars 2a and transverse spars 13, and of a frame 3 which forms a lying surface and which in the embodiment shown is covered by an elastic knit 4. The frame 3 consists of two longitudinal spars 5, which can be buckled and which are spaced by means of transverse spars 6. The longitudinal spars 5, which can be buckled, permit in a manner known per se the division of the lying surface of the bed into several sections which can be inclined with respect to one another at defined angles, as illustrated in FIG. 1. However, the longitudinal spars 5 can also be changed into a flat straight position, so that the bed has a plane lying surface.

In the embodiment shown, the adjusting of the longitudinal spars takes place in a known manner by way of an electric drive which is not shown in detail.

The knit 4 clamped into the frame 3, in the embodiment shown—as in the case of the lounger bed according to the earlier Patent Application 198 07 741.6—consists of elastic synthetic threads. This knit can be tensioned in a bidirectional manner, and it is inserted, at least in the transverse direction between the two longitudinal spars 5 in the prestressed condition, into the frame 3, as described in detail in the earlier Patent Application 198 07 741.6. However, the knit can also be braced in the longitudinal direction between the transverse spars 6 which therefore have the same construction as the longitudinal spars 5.

Figure 2:
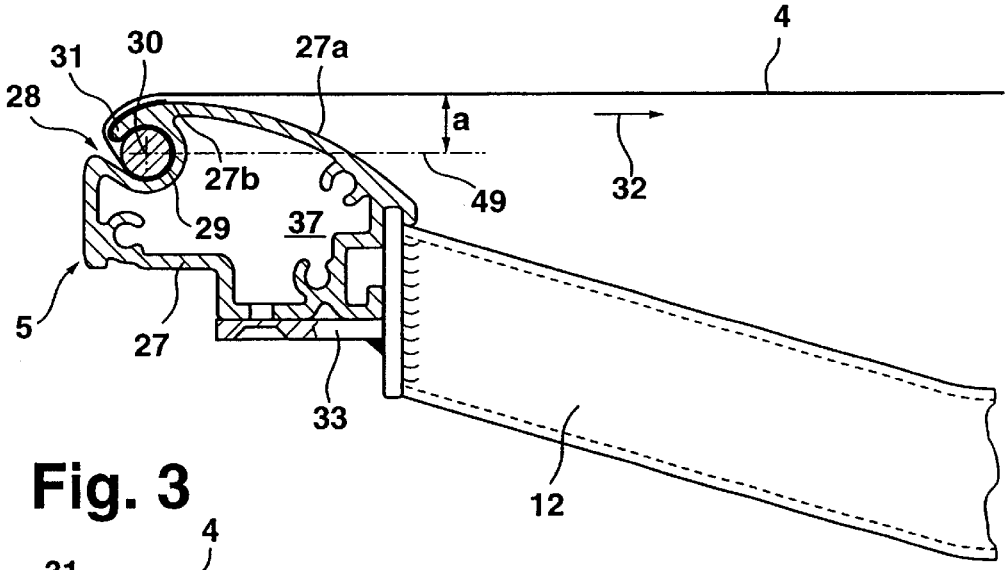
FIG. 2 is an enlarged partial representation of a sectional view taken along section plane II—II of FIG. 1 of one of the longitudinal spars, which consists of a drawn profile.

As illustrated in FIG. 2, in addition to being provided with the two transverse spars 6 at their ends, the longitudinal spars 5 are also in each case provided in the area of their two hinge axes 9 and 10 with additional transverse struts. Thus, in the area of the hinge axle 9, which, like the hinge axle 10, is not formed by a continuous axle, but is provided with hinge arrangements 25 only in the area of the longitudinal spars 5, which hinge arrangements 25 will be explained in the following, a linking to the basic frame is provided, while, in the area of the hinge axle 10, an additional transverse stiffening bow 12 is provided. In this manner, a stable supporting frame is formed which is suitable for holding the inserted knit 4 under a defined tension.

Figure 3:
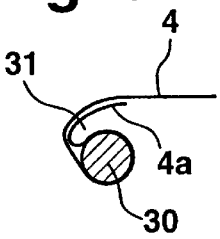
FIG. 3 is a partial representation of the edge of the textile structure according to FIG. 2, which forms the lying surface, which edge is prepared for being clamped into the longitudinal spars.

FIG. 2 illustrates that the longitudinal spars 5, which are subjected to considerable transverse forces, and also the transverse spars 6 consist of a drawn hollow profile 27 which, in each case, has a curved surface 27*a* sloping toward the frame interior, which surface 27*a,* in the area of its exterior edge, forms a supporting surface 27*b* for the textile structure 4. This supporting surf ace 27*b* changes into a curvature descending toward the outside and then into a receiving groove 28 which is used for clamping in the elastic knit 4. Within the hollow profile 27, the receiving groove 28 expands to a chamber 29 of a circular cross-section which is adapted to the cross-section of the round rod 30, specifically such that this round rod 30, together with the edge 4*a* of the knit 4 wound around it, can be axially introduced into the groove formed by the chamber 29. As illustrated in FIG. 3, as the result of the construction of the receiving groove 28 situated on the exterior side of the longitudinal spar 5 with the chamber 29, a clamping edge 31 is created against which the edge 4*a* folded around the rod is pulled and clamped because the knit 4 is subjected to a tension force in the sense of the arrow 32 (FIG. 2).

FIG. 2 also shows that the transverse stiffening bow 12 is fixedly and in a stable manner joined to the longitudinal spar 5 and can be screwed by means of a screwed connection, which is not shown, by way of a bracket 33 to this longitudinal spar 5.

FIG. 2 also shows that the receiving grooves 28 and their chambers 29 are arranged as closely as possible to the plane of the lying surface formed by the textile structure 3, so that a horizontal plane 49 placed through the center of the chambers 29 of the receiving grooves 28 is arranged at a distance a to this lying surface. As will be explained in the following, the hinge axes 9 (or 10) each extend in this horizontal plane 49. The hinge axes are therefore situated very close to the lying surface, which has the advantage that the textile structure, which also spans the joint points, during the buckling of the longitudinal spars and therefore during an adjusting of the lying surface, as illustrated in FIG. 1, is subjected to no large length changes in the direction of the axis of the longitudinal spars 5. These length changes can therefore be absorbed by the elastic textile structure 4 without any unattractive formation of folds which results in wear. Thus, the textile structure 4 does not have to be provided with recesses at the hinge points as is otherwise customary.

Figure 4:
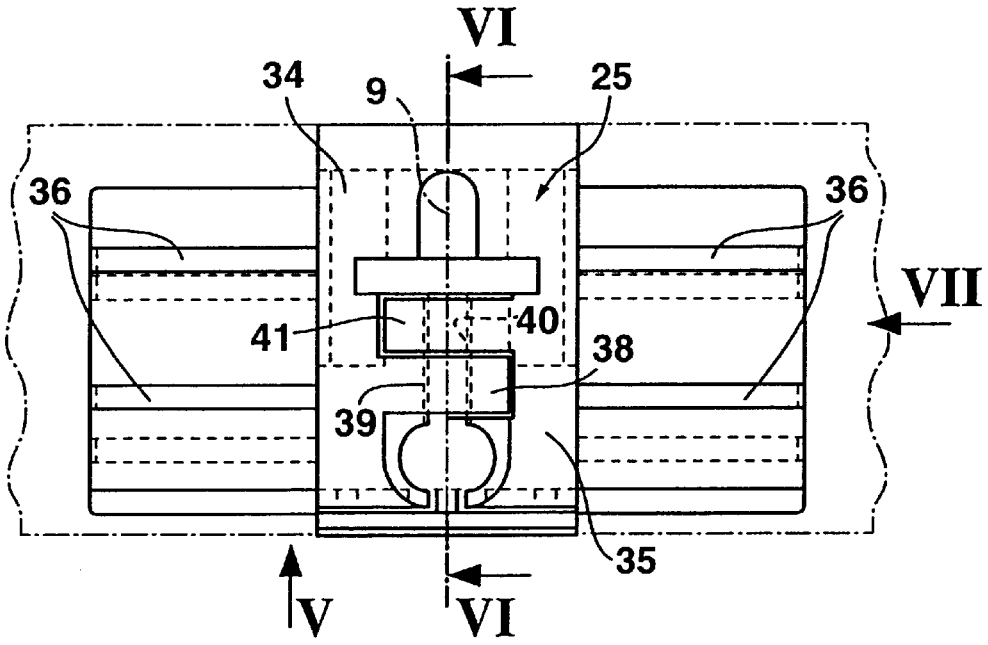
FIG. 4 is a top view of one of the two hinges forming the buckling axis between the backrest and the center part at point IV of FIG. 1.
Figure 5:
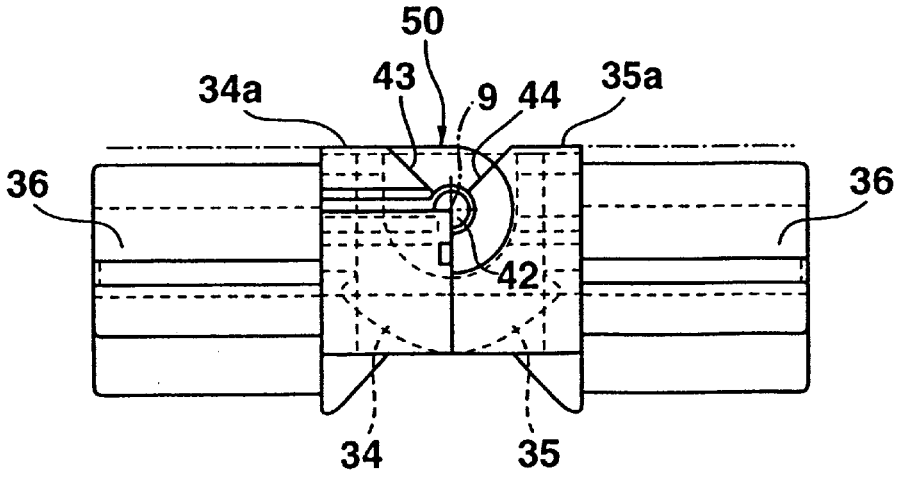
FIG. 5 is a view of the hinge of FIG. 4 viewed in the direction of the arrow V of FIG. 4.

FIG. 4 illustrates that the hinge 25 at the longitudinal spars 5 consists of two hinge heads 34 and 35 which are in each case, on the end face sides, slid into the open longitudinal spars and which are each provided with ribs projecting to the side and are pushed, together with these, into the open hollow space 37 of the hollow profile 27. In this case, the hinge head 34 has a hinge bracket 38 with a bore 39 which extends along the hinge axle 9 and is aligned with a bore 40 in a hinge bracket 41 of the hinge head 35, so that a bolt 42 extending in the axle 9 can be pushed through the two bores 39 and 40.

Figure 6:
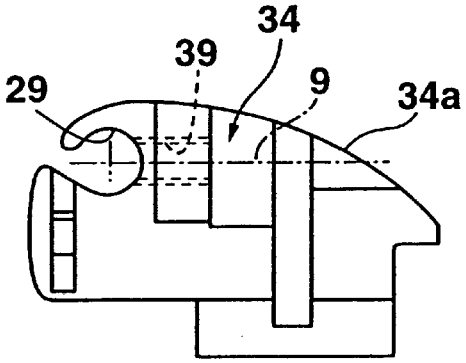
FIG. 6 is a view of one of the two hinge heads forming the hinge according to FIG. 4 viewed in the direction of section VI—VI of FIG. 4.
Figure 7:
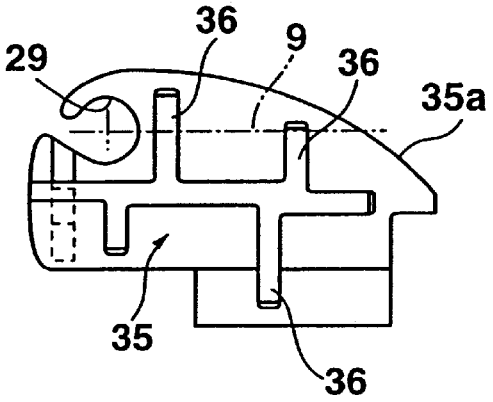
FIG. 7 is a view of the second hinge head of the hinge according to FIG. 4 viewed in direction VII of FIG. 4.

FIGS. 6 and 7 show that the two hinge heads 34 and 35 are provided with a surface 34*a* and 35*b* which corresponds to the contour of the top side 27*a* of the hollow profile 27. For the hinge 25, which is illustrated in FIGS. 4 to 8, a wedge-shaped recess 50, which tapers to the hinge axle 9, is provided on the top side of these adjoining surfaces 34*a* and 35*a,* which recess 50 is in each case formed by diagonal surfaces 43 and 44 which extend from the top sides 34*a* and 35*a* in each case as plane surfaces to the hinge axle 9.

Figure 8:
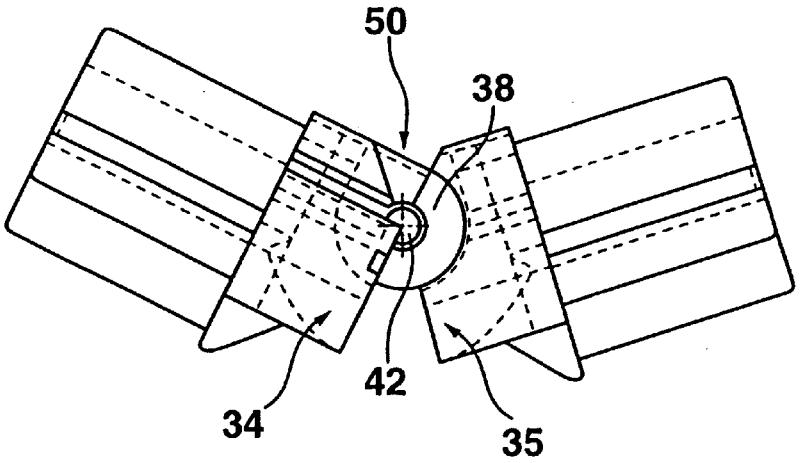
FIG. 8 is the representation of the hinge according to FIG. 5, however, in the buckled condition.

As illustrated in FIG. 8, by means of this further development, it becomes possible to fold open the longitudinal spars at the hinges 25 at an angle of up to 90° from the horizontal plane upwards. The hinge heads provided for the hinge axle 10 between the center part and the foot part have a similar construction and also have a top side adapted to the contour of the hollow profiles 27. However, it must be provided in this case that these hinge heads permit a swivelling of the center part and the foot part about an angle of up to 90° in the downward direction, which is not explained in detail but has the result that a wedge-shaped gap is formed similar to the recess 50 on the top side of the corresponding hinge heads when the center part is swivelled downward with respect to the foot part, as illustrated in FIG. 1. However, in both cases, the wedge-shaped gap between the top sides of the hinge heads in the respectively assigned position of the lying surface remains so small that no disadvantages arise for the supporting surface in the area of the hinge axes 9 and 10. The elastic knit can expand or contract correspondingly in order to provide the required compensation. A compressing or fold formation is avoided.

Figure 9:
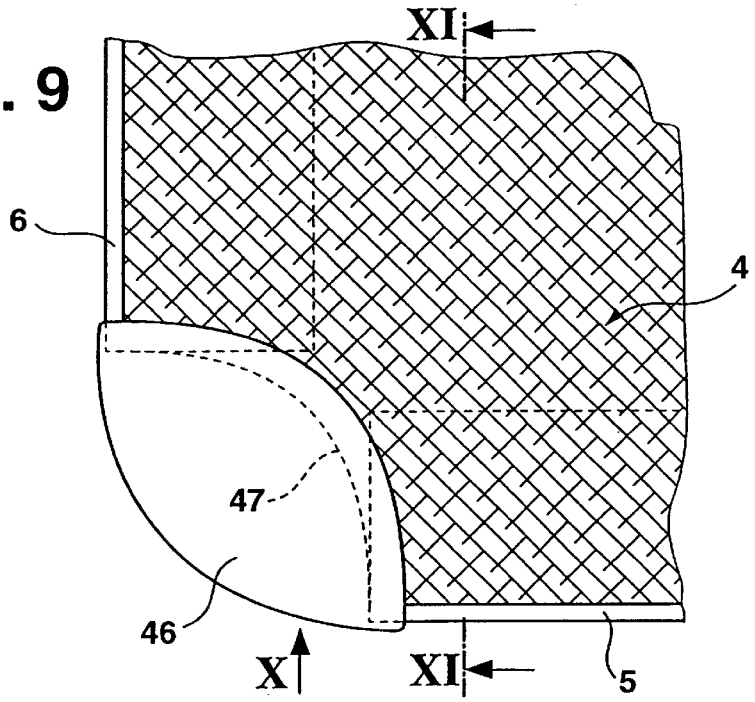
FIG. 9 is an enlarged representation of the corner area IX of FIG. 1, but in the case of an embodiment in which, instead of the drawn profiles according to FIG. 2, longitudinal spars are provided which are made of bent sheet metal.
Figure 10:
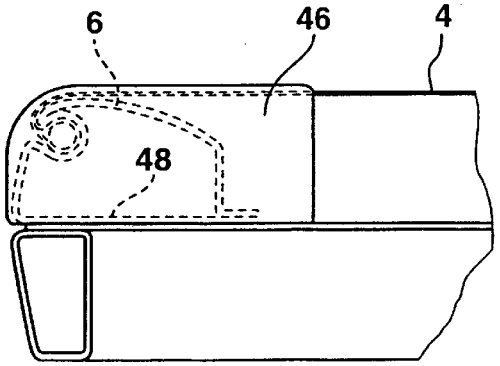
FIG. 10 is a view of the corner according to FIG. 9 viewed in the direction of the arrow X of FIG. 9.
Figure 11:
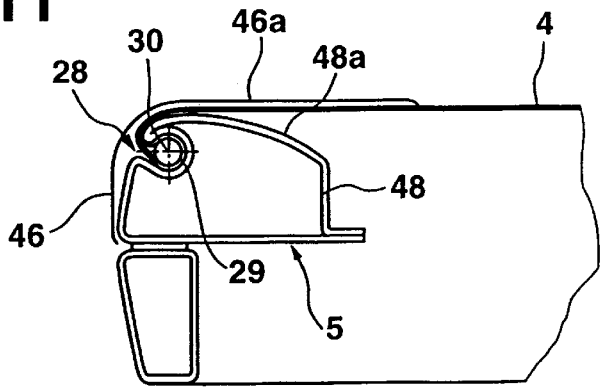
FIG. 11 is a sectional view along Line XI—XI of FIG. 9.

FIGS. 9 to 11 show the construction of a corner 45 of the lounger bed according to FIG. 1. It is illustrated that a corner covering 46 is provided in the area between the longitudinal spars 5 and the transverse spars 6 which are otherwise fixedly connected with one another. In this area, the knit 4 is provided with a recess which is approximately quarter-circle-shaped and extends along the broken line 47, if a sharp corner edge between the longitudinal spars 5 and the transverse spars 6 is to be avoided. This recessed area of the knit 4 is covered by a cap-shaped top side 46a of the corner covering 46 which, in a manner not shown in detail, is fixedly connected with the longitudinal and transverse spars 5 and 6. It is naturally also conceivable to construct this corner covering 46 such that it can be used for the stable connection of longitudinal spars 5 and transverse spars 6. However, it is also possible to connect these longitudinal spars 5 and the transverse spars 6 by a stiffening extending transversely to these.

FIGS. 10 and 11 illustrate that the longitudinal spars 5 and the—indicated by a broken line in FIG. 10—transverse spars 6 may consist of a bent sheet metal strip 48 which may also be equipped with a curved surface provided analogously to the surface 27*a* of the drawn profile 27 and with a receiving groove 28 provided on its exterior side, which receiving groove 28 merges into the chamber 29 for receiving the rod 30 with the folded-around knit 4. Also in this case, the same prerequisites apply to the clamping-in and the function which were explained by means of FIGS. 2 and 3. However, the manufacturing of the longitudinal and transverse spars from a bent sheet metal strip reduces the weight of the lounger bed and its manufacturing expenditures.

As mentioned above, in all embodiments, an elastic knit 4 was provided for forming the lying surface which can be tensioned in a bidirectional manner and therefore, as also mentioned above, has significant advantages for the lying surface of a bed. However, the invention can also be used when a textile structure of a different type is provided, such as a fabric covering without any elastic threads. For the clamping into the receiving grooves, it is important that the textile structure is held in the frame under a certain prestress which will then provide the required locking in the chambers 29.

Naturally, it would also be conceivable to, instead of using the illustrated construction, not place the textile structure by means of its edge 4*a* around a rod 36 and then clamp it into a groove, but to construct the receiving groove 28 as a clamping slot with essentially parallel walls, into which the edge 4*a* is then introduced and is clamped in, for example, by the screwed connection of two jaws forming the clamping slot. However, the illustrated embodiment has advantages particularly if, as mentioned initially, the textile structure is provided with elastic threads and is to be tensioned to different degrees in different sections along the length of the longitudinal spars.

What is claimed is:

1. Lounge bed with an adjustable lying surface comprising:

a frame with transverse spars and buckling longitudinal spars, and a textile structure, wherein each of the longitudinal spars define a profile strip with a curved longitudinal spar top side, the textile structure reaching over the curved longitudinal spar top side, wherein each longitudinal spar top side has a curvature which slopes down toward an interior of the frame such that supporting surfaces for the textile structure are formed only in an exterior area of the frame, and wherein an edge of the textile structure is introduced into and held in a receiving groove at the exterior side of each of the profile strips.

2. Lounge bed according to claim 1, wherein each of the transverse spars define a profile strip with a curved transverse spar top side, the textile structure reaching over the curved transverse spar top side, wherein each transverse spar top side has a curvature which slopes down toward the interior of the frame such that supporting surfaces for the textile structure are formed only in the exterior area of the frame, wherein the edge of the textile structure is introduced into and held in the receiving groove at the exterior side of each of the profile strips, and the textile structure is tensioned in the longitudinal and transverse direction.

3. Lounge bed according to claim 2, wherein the buckling longitudinal spar includes hinge axes for buckling points thereof, and wherein each of the receiving grooves are arranged closely adjacents to the plane of the lying surface, and the hinge axes for the buckling points of each of the longitudinal spars extend in a horizontal plane placed through the center of each of the receiving grooves.

4. Lounge bed according to claim 2, wherein the receiving groove of each of the longitudinal and transverse spars leads into a slot into which the edge of the textile structure is clamped.

5. Lounge bed according to claim 2, wherein the receiving groove merges into a chamber whose cross-section is adapted to the cross-section of a rod around which the edge of the textile structure is loosely folded and is locked in the chamber.

6. Lounge bed according to claim 1, wherein the buckling longitudinal spar includes hinge axes for buckling points thereof, and wherein each of the receiving grooves are arranged closely adjacent to the plane of the lying surface, and the hinge axes for the buckling points of each of the longitudinal spars extend in a horizontal plane placed through the center of each of the receiving grooves.

7. Lounge bed according to claim 6, wherein the buckling points for the longitudinal spars are formed of hinge heads which are aligned with and held in the longitudinal spars, and are assigned to one another in pairs, and are adapted on their top side to the profile contour of the longitudinal spars.

8. Lounge bed according to claim 7, wherein the textile structure has a continuous construction in the area of the hinges.

9. Lounge bed according to claim 6, wherein the receiving groove merges into a chamber whose cross-section is adapted to the cross-section of a rod around which the edge of the textile structure is loosely folded and is locked in the chamber.

10. Lounge bed according to claim 1, wherein the receiving groove of each of the longitudinal spars leads into a slot into which the edge of the textile structure is clamped.

11. Lounge bed according to claim 10, wherein the slot is formed of two parts which adjoin one another and can be screwed to one another.

12. Lounge bed according to claim 1, wherein the receiving groove of each of the longitudinal spars merges into a chamber whose cross-section is adapted to the cross-section of a rod around which the edge of the textile structure is loosely folded and is locked in the chamber.

13. Lounge bed according to claim 7, wherein the rod is divided into sections which extend the length of the longitudinal spars to the hinge heads.

14. Lounge bed according claims 1, wherein the textile structure has a continuous construction in the area of the hinges.

15. Lounge bed according to claim 1, wherein the longitudinal spars and the transverse spars consist of a hollow profile with a curved top side which merges on the outside into the receiving grooves of each of the longitudinal and transverse spars.

16. Lounge bed according to claim 15, wherein the hollow profile of the longitudinal and transverse spars consists of a drawn metal or a plastic profile.

17. Lounge bed according to claim 15, wherein the hollow profile consists of a bent sheet metal strip.

18. Lounge bed according to claim 17, wherein the bent sheet metal strip is made of steel.

19. Lounge bed according to claim 18, wherein the textile structure is comprised of elastic threads.

20. Lounge bed according to claim 1, wherein the textile structure is provided with a recess on the corners of the supporting frame and is fastened only to the parts of the transverse and longitudinal spars which are fixedly connected to one another.

21. Lounge bed according to claim 20, wherein the area of the recess is covered by a corner covering which is fastened to the longitudinal and transverse spars.

22. Lounge bed according to claim 1, wherein the textile structure consists of elastic threads.

23. Lounge bed according to claim 1, wherein the textile structure is comprised of elastic threads.

24. A spar member which in use forms a tensioning frame for a textile structure of a lounge bed, said spar member being a hollow profile member comprising:

a curved top side which slopes downwardly toward an interior frame space when in an in use position on a lounge bed, a textile structure supporting surface section adjacent a top part of the curved top side, and a receiving groove for the textile structure which is adjacent the supporting surface section and facing away from an interior frame space when in an in use position in a lounge bed.

25. A spar member according to claim 24, wherein the receiving groove merges into a chamber whose cross-section is adapted to the cross-section of a rod around which the edge of the textile structure is loosely folded and is locked in the chamber.

26. Lounge bed with an adjustable lying surface which consists of a frame with transverse spars and buckling longitudinal spars and of a textile structure comprising elastic threads, which is clamped in at least at the longitudinal spars, wherein the longitudinal spars comprise profile strips with a curved top side, the textile structure reaching over the curved top side, in that the curvature of the top side slopes down toward the interior of the frame, and in that supporting surfaces for the textile structure are formed only in the exterior area of the frame, the edge of the textile structure being introduced into receiving grooves at the exterior side of the profile strips and being held there; and wherein the transverse spars comprise profile strips with a curved top side, the textile structure reaching over the curved top side, in that the curvature of the top side slopes down toward the interior of the frame and supporting surfaces for the textile structure are formed only in the exterior area of the frame, the edge of the textile structure being introduced into receiving grooves at the exterior side of the profile strips and being held there, and in that the textile structure is tensioned in the longitudinal and transverse direction.

27. Lounge bed according to claim 26, wherein the lying surface is adjustable and the receiving grooves are arranged as closely as possible to the plane of the lying surface, and in that the hinge axes for the buckling points of the longitudinal spars extend in a horizontal plane placed through the center of the receiving grooves.

28. Lounge bed according to claim 26, wherein the receiving groove leads into a slot into which the edge of the textile structure is clamped.

29. Lounge bed according to claim 26, wherein the receiving groove merges into a chamber whose cross-section is adapted to the cross-section of a rod around which the edge of the textile structure is loosely folded and is locked in the chamber.

30. Lounge bed with an adjustable lying surface which consists of a frame with transverse spars and buckling longitudinal spars and of a textile structure comprising elastic threads, which is clamped in at least at the longitudinal spars, wherein the longitudinal spars comprise profile strips with a curved top side, the textile structure reaching over the curved top side, in that the curvature of the top side slopes down toward the interior of the frame, and in that supporting surfaces for the textile structure are formed only in the exterior area of the frame, the edge of the textile structure being introduced into receiving grooves at the exterior side of the profile strips and being held there; and wherein the longitudinal spars and the transverse spars, consist of a hollow profile with a curved top side which merges on the outside into the receiving groove.

31. Lounge bed according to claim 30, wherein the hollow profile of the longitudinal and transverse spars consists of a drawn metal or of a plastic profile.

32. Lounge bed according to claim 30, wherein the hollow profile consists of a bent sheet metal strip comprised of steel.

* * * * *